United States Patent [19]

Horne

[11] 3,958,555

[45] May 25, 1976

[54] FLUID SUPPLY SYSTEMS

[75] Inventor: Alexander Dewar Horne, Johnstone, Scotland

[73] Assignee: The Horne Engineering Co., Ltd., Johnstone, Scotland

[22] Filed: Sept. 23, 1974

[21] Appl. No.: 508,267

[30] Foreign Application Priority Data

| | | |
|---|---|---|
| Sept. 29, 1973 | United Kingdom | 45638/73 |
| Jan. 18, 1973 | United Kingdom | 48480/73 |
| Nov. 9, 1973 | United Kingdom | 52058/73 |
| Nov. 24, 1973 | United Kingdom | 54636/73 |

[52] U.S. Cl. ..... 126/362; 236/12 R; 237/8 A

[51] Int. Cl.[2] ..... F24H 1/22

[58] Field of Search..... 126/362; 236/12 R, 12 A, 236/18, 19; 237/8 A

[56] References Cited

UNITED STATES PATENTS

| | | | |
|---|---|---|---|
| 1,377,714 | 5/1921 | Manning et al. | 126/362 |
| 1,992,251 | 2/1935 | Stewart | 126/362 X |
| 2,245,967 | 6/1941 | Dillon | 126/362 |
| 3,413,969 | 12/1968 | Whittell, Jr. | 126/362 |
| 3,522,909 | 8/1970 | Arant | 126/362 X |
| 3,688,839 | 9/1972 | Kirschner | 126/362 X |
| R19,488 | 3/1935 | Russell et al. | 126/362 X |

*Primary Examiner*—William E. Wayner
*Assistant Examiner*—William E. Tapolcai, Jr.
*Attorney, Agent, or Firm*—Mason, Fenwick & Lawrence

[57] ABSTRACT

A fluid supply system for supplying a fluid draw-off such as for example domestic showers includes a fluid blending valve discharging blended liquid into a recirculation pipeline delivering to the draw-off and returning to a cold inlet of the blending valve, liquid recirculation occurring when the draw-off is closed, and a pump is preferably provided to ensure satisfactory recirculation. At least a portion of the recycled liquid is fed to a heat exchanger. To ensure that the temperature of the recycled liquid is maintained at a desired value, which is particularly desirable in the case of a shower installation where excess temperature can be physically dangerous, an additional thermostatic control valve is provided responsive to the recycled liquid temperature and operatively associated with the heat exchanger to maintain the recycled liquid temperature.

13 Claims, 8 Drawing Figures

FLUID SUPPLY SYSTEMS

The present invention relates to a fluid supply system of the type including a thermostatic blending valve having hot and cold inlets for respectively receiving relatively hot and cold fluids from suitable supply sources and discharging a blended fluid at a selected temperature, a draw-off (or heat exchanger) to which the blended fluid is supplied, and fluid recirculation means for delivering blended fluid to the draw-off and for return of fluid to the blending valve: such a system has as an object the maintenance of the blended (recirculated) fluid at a suitable temperature so as to be in a condition for immediate use at the draw-off and the system is hereinafter referred to as a recirculation fluid supply system of the type aforesaid.

In a previous recirculation fluid supply system of the type aforesaid, the system was used as a water shower or spray installation, the shower (or showers) constituting the draw-off, and a recirculation line from the showers including a pump and discharging directly into a cold feed line to a calorifier supplying hot water to the blending valve, a branch line being provided downstream from the recirculation line for the supply of "cold" water from the feed line to the valve. However, with the showers shut-off, tepid water is returned to the cold inlet of the blending valve and to maintain the desired temperature of blended discharged liquid it is necessary for the blending valve hot inlet to be virtually closed. Closure of the hot inlet requires a temperature rise in the valve, and in practice the rise in temperature to cause closure of the blending valve hot inlet results in the blended liquid temperature rising quite substantially above the desired value. For example, whereas a 40°C blended liquid temperature may be desired, at full recirculation the valve may discharge at 48°C: this can be dangerous in a shower installation due to the risk of scalding.

It is an object of the present invention to obviate or mitigate this disadvantage.

According to the present invention a recirculation fluid supply system includes fluid recirculation circuit means for the supply of temperature blended fluid to a draw-off (or heat exchanger), a thermostatic blending valve having hot and cold inlets for receiving relatively hot and cold fluids from supply sources and discharging the blended fluid into the recirculation circuit means, the recirculation circuit means including heat exchanger means for heating at least a portion of the fluid recirculated by the circuit means, and a temperature control device responsive to the temperature of fluid in the circuit means and operatively associated with the heat exchanger means to ensure that the recirculated fluid is passed to the draw-off or heat exchanger at the desired temperature.

Preferably the recirculation circuit means includes a primary conduit from the draw-off to the cold inlet of the blending valve, the primary conduit having a pump intercalated therein, and the temperature control device is constituted by a thermostatic diverting valve in the primary conduit having a branch discharge for the diversion of recirculated fluid to the hot fluid supply source, and cold feed conduit means are connectible to a cold fluid supply source for the supply of cold feed to the hot fluid supply source and to the blending valve, the arrangement being such that when the temperature of the recirculated fluid falls below a selected value the thermostatic diverting valve directs a portion of the recirculated fluid to the hot supply source to provide an increased flow of hot fluid to the hot inlet of the blending valve to increase the temperature of the blended fluid but when the recirculated fluid reaches said selected temperature substantially all the recirculated fluid is directed to the cold inlet.

The thermostatic diverting valve preferably comprises a housing having a fluid inlet duct and a fluid outlet duct with the primary conduit connected to said ducts so that the recirculated fluid flowing to the cold inlet passes through the housing, a valve body secured to said housing and including a thermoresponsive element projecting into the housing to be in the flow stream of the recirculated fluid, a branch discharge on the valve body fluidly connected to the hot fluid supply source, and a valve opening in the valve body controllable by a closure head operatively coupled to the thermoresponsive element for control of recirculated fluid outflow via the branch discharge. The housing can conveniently comprise a T-junction member, two transverse openings of said T constituting the inlet and outlet ducts while the remaining opening fixedly receives said valve body.

The primary conduit may be connectible to the cold inlet of the blending valve; or alternatively may be connectible to an external fluid inlet duct discharging into the temperature control portion of the blending valve, so that the fluid recirculated by the primary conduit by-passes the mixing portion of the blending valve.

In a preferred embodiment of the present invention, a calorifier unit is provided and includes a vessel for receiving recirculated fluid from the draw-off (or heat exchanger) and having a discharge for outflow of fluid to the draw-off, and a thermostatic blending valve carried by the vessel and discharging into the vessel, a temperature responsive element of the blending valve controlling the blended fluid temperature being located in the vessel to be responsive to the temperature of fluid therein, and heating means for the recirculated liquid carried by the vessel and including temperature control means controlling the operation of the heating means so as to maintain the recirculated fluid flowing through the vessel at the desired temperature.

In a further preferred embodiment of the present invention, the recirculation circuit means includes a primary circuit linking the draw-off with a cold inlet of the blending valve and the temperature control device is located in this primary circuit, the temperature control device being in the form of a temperature responsive diverting valve a branch portion of which is fluidly connected to a branch circuit of the circuit means, which branch circuit discharges into the hot inlet of the blending valve, the heat exchanger means being located in this branch portion for heating the portion of recirculated fluid flowing in the branch portion to the hot inlet so as to maintain the desired blended temperature and a pump is provided in the primary circuit for fluid recirculation.

Embodiments of the present invention will now be described by way of example with reference to the accompanying drawings in which.

In the various embodiments, like items are referred to by the same reference numeral.

Figure 2:
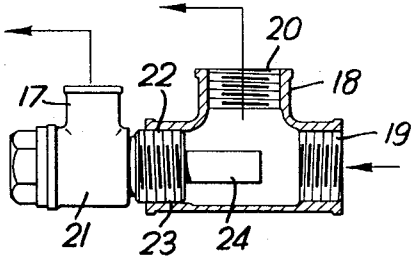
FIG. 2 shows in partial cross-section an elevational view of a temperature limiting valve used in the system of FIG. 1.
Figure 1:
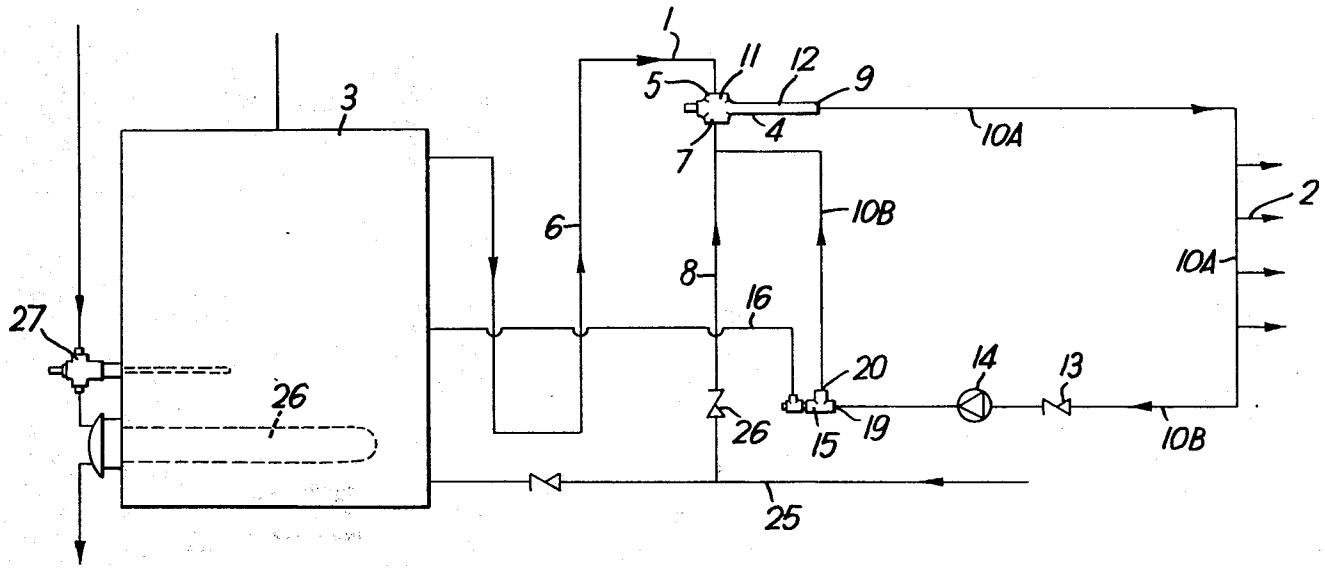
FIG. 1 shows a schematic view of a tepid water supply system for domestic showers, according to one embodiment of the present invention.

Referring to FIGS. 1 and 2, a recirculation heating system 1 for the supply of tepid (~40°C) water to a series of domestic showers 2 includes a thermostatically controlled hot water calorifier 3 having a heating coil 26 and thermostatic control valve 27; a blending valve 4 having a hot inlet 5 receiving hot water from said calorifier 3 via line 6, a cold inlet 7 supplied with relatively cold water via line 8, and a discharge 9 for thermally blended water fluidly connected to the showers by a delivery pipeline 10A of a water recirculation circuit. It will be understood that some other source of hot water than the calorifier 3 could be used such as for example a combination oil fired or gas fired hot water boiler. The blending valve 4 can satisfactorily be of the type described in the Applicant's U.K. Pat. No. 1,294,469 and includes a mixing portion 11 at the inlets 5, 7 and a temperature control portion 12 including discharge 9, and a control element (not shown) the valve 4 being set to provide blended water for the showers 2 at the desired tepid temperature. So that tepid water may be immediately available when a shower 2 is turned on, a water recirculation circuit is provided for the recirculation of tepid water and includes said delivery pipeline 10A and a return pipeline 10B from the showers 2 to the blending valve cold water inlet 7, a one way valve 13 being located in the circuit 10A, 10B, together with a pump 14.

Further, the circuit includes a thermostatic diverting valve 15 in the form of a temperature limiter, and the circuit has a branch portion 16 from a branch discharge 17 of valve 15 to the calorifier 3 so that, due to flow of water to the calorifier 3 via line 16, a small hot water flow may be directed to the blending valve hot inlet 5 via line 6 to cater for heat losses in the circuit. the limiter valve 15 (see FIG. 2) comprises a housing in the form of a T-junction piece 18, two mutually transverse openings 19, 20 of which are coupled to consecutive sections of the return pipeline 10B, a valve body 21 having a boss 22 screwed to the remaining opening 23 of the T-piece, and carrying the branch discharge 17, a valve opening (not shown) in said valve body 21, and a temperature responsive element 24 in the housing 21 in the flow path of the recirculated water so as to be responsive thereto and operatively coupled to a closure head (not shown) in the valve body 21 controlling the valve opening and thereby the recirculated fluid flows through the branch discharge 17.

Also, a cold feed line 25 from a suitable cold water supply source is connected to the calorifier for feed make up at for example in the region of 10°C and the line 8 is connected to this feed line 25 for make up of the cold water supply to the blending valve 4, particularly when the showers are fully opened with virtually no recirculating water flow, the line 8 including a one-way valve 26.

In operation of the above recirculation system with the showers 2 fully shut-off and the tepid water at the desired temperature (40°C) the pump 14 will deliver substantially all of the recirculated water to the blending valve cold inlet 7 via line 10B. However, to compensate for heat losses in the circuit 10A, 10B, the limiter valve 15 will allow the pump 14 to pass a small portion of recirculated water to the calorifier 3 and consequently a small flow of hot water (at 65°C. in this example) is urged to the blending valve hot inlet 5. If the recirculated water exceeds the desired temperature value, the limiter 15 closes to stop the hot water flow and thereby regulates the blended water to the desired temperature. Again, if the recirculated water falls below the desired temperature, the limiter valve 15 increases the flow of recirculated water to the calorifier 3 so that the pump delivers an increased quantity of hot water to the blending valve 4 from the calorifier 3. When there is no water recirculation, as occurs with the showers 2 fully opened, the cold feed line 8, 25 maintains the cold water supply to the calorifier 3 and to the blending valve 4.

With the above heating system 1 according to the present invention, the blended tepid water is prevented from rising substantially above the desired temperature when the showers are fully turned off i.e. with complete recirculation, by virtue of the influence of the limiter valve 5. Further, in the present arrangement during complete or substantially complete recirculation of blended water, the control valve element of the blending valve 4 is set in such a position to enable the valve to promptly supply the necessary quantity of tepid blended water when the demand at the showers 2 increases. Whereas the above described system relates to a shower installation it will be understood that the invention could be applied to other types of recirculation fluid supply system, for example to those supplying blended fluid to a heat exchanger.

Figure 3:
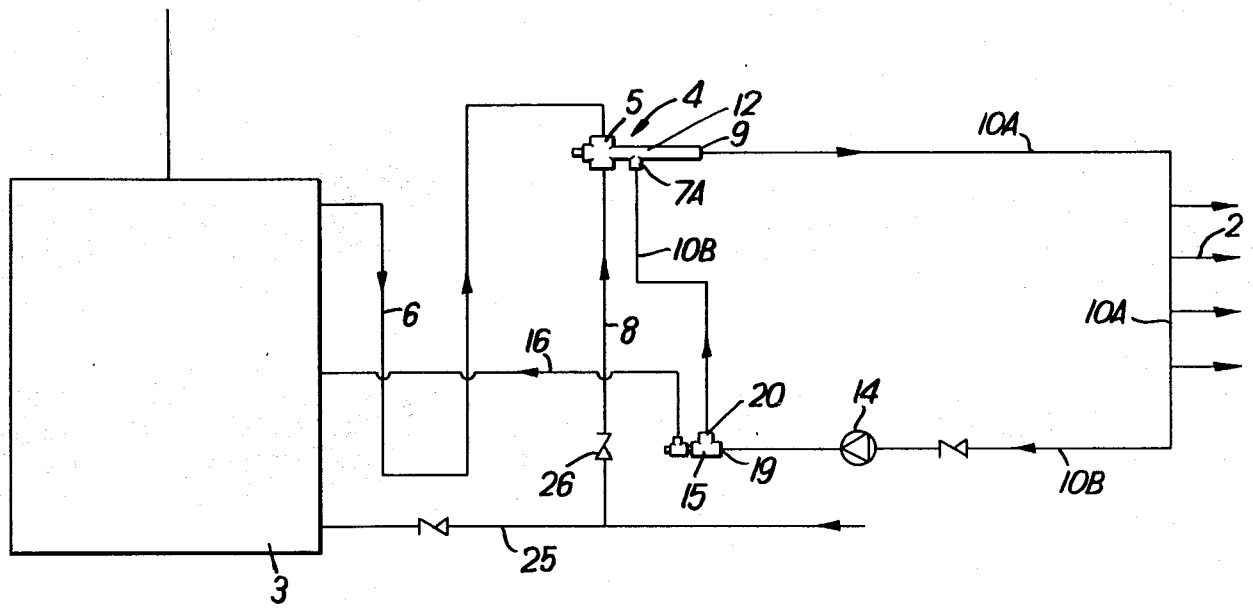
FIG. 3 shows a modified form of the water supply system of FIG. 1.

FIG. 3 shows a modification to the system of FIG. 1. In the arrangement shown in FIG. 3 an additional cold inlet duct 7A is located on the blending chamber casing 12 for fluid discharge into the chamber, and preferably but not necessarily closely adjacent the mixing valve portion 11, and the return conduit 10B is connected to this additional inlet 7A rather than to the cold inlet 7 of the mixing portion 11 although the cold make-up feed line 8 is connected to this latter inlet 7 as before. Consequently, tepid water recirculated via the conduit 10B by-passes the mixing valve portion 11 of the blending valve 4, and in fact during full recirculation, the blender valve 4 in effect imparts no control over the temperature of the recirculated fluid, the temperature control of the recirculated fluid being maintained by the diverting valve 15. In practice this arrangement has proved to provide very satisfactory temperature control. With fluid recirculated at the correct temperature over the temperature responsive element of the blender valve 4, the element is at the correct temperature setting as a result of which the blending valve is in approximately the correct setting. When fluid draw-off commences at the showers 2 therefore the blending valve 4 is at approximately the desired setting and the valve does not have to make a substantial correction to the setting.

Figure 4:
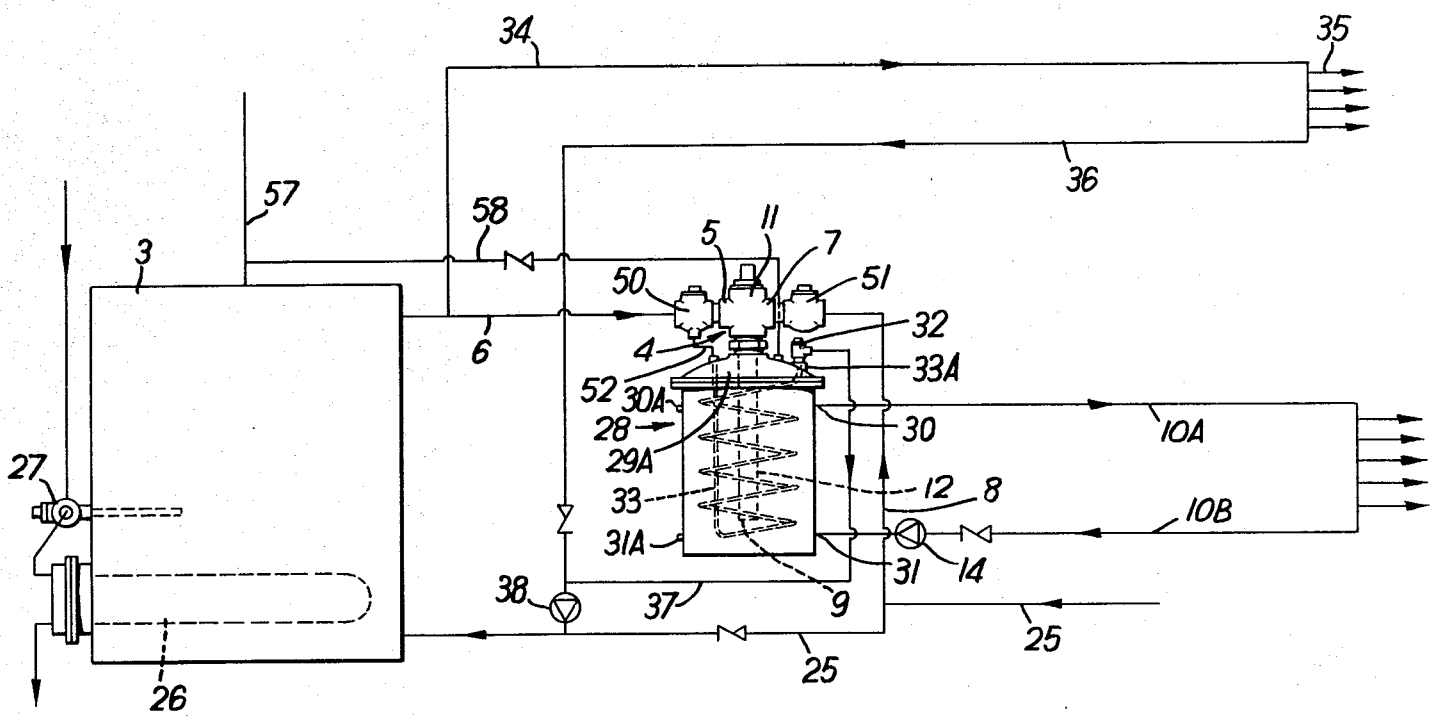
FIG. 4 shows a schematic view of a tepid water supply system for domestic showers, according to a further embodiment of the present invention.
Figure 5:
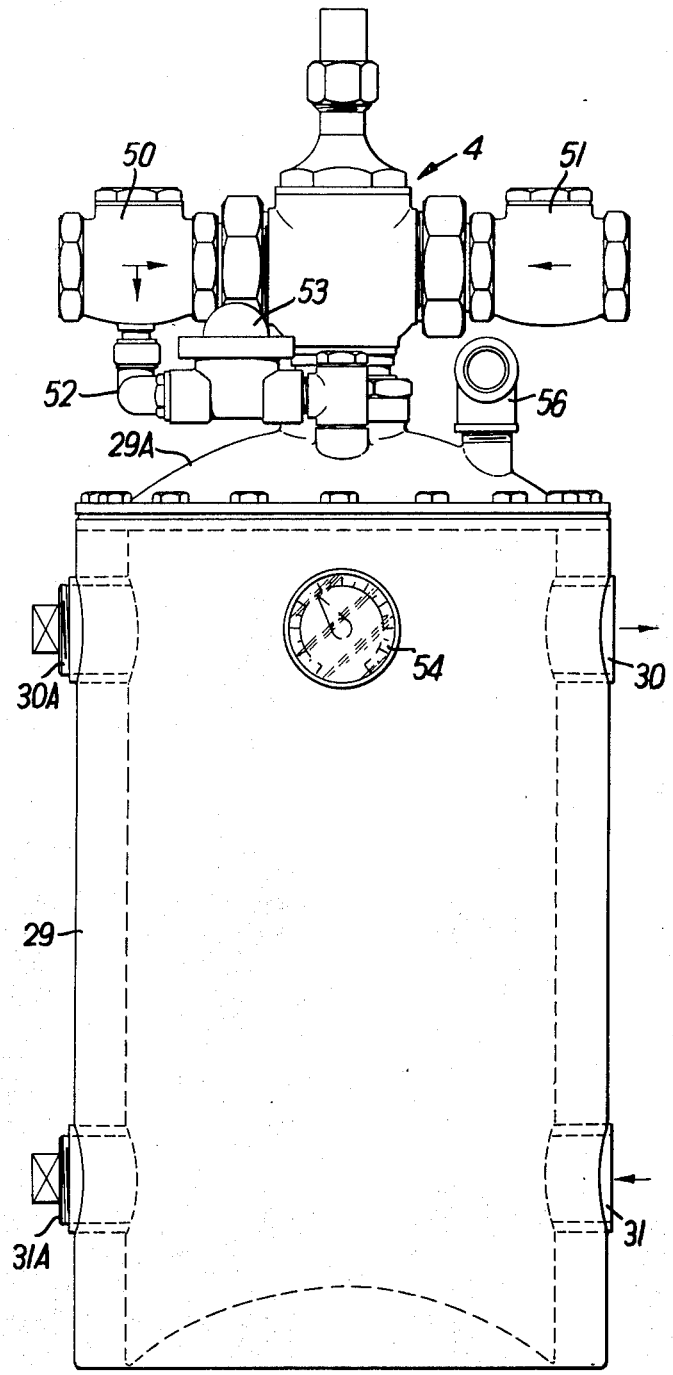
FIG. 5 shows a detailed elevational view of the calorifier unit of FIG. 4.
Figure 6:
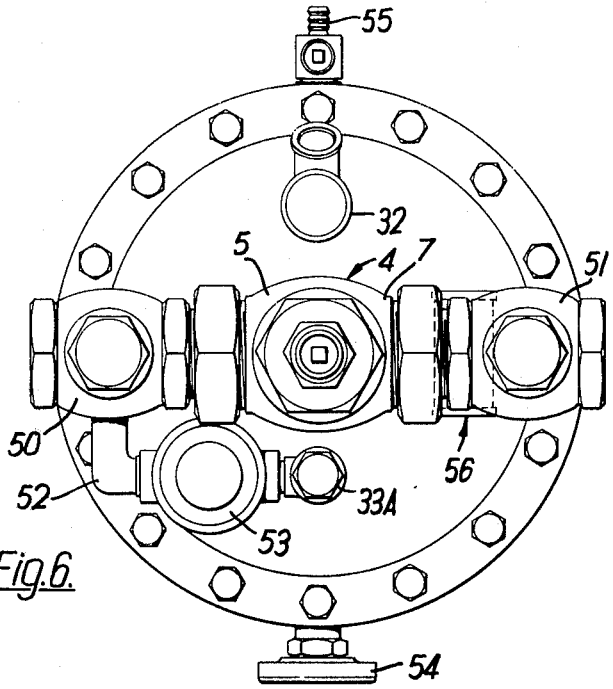
FIG. 6 shows a plan view of the calorifier unit of FIG. 5.

In the embodiment of the present invention shown in FIGS. 4, 5 and 6, the tepid water recirculation circuit includes a small calorifier unit 28 (shown per se in FIGS. 5 and 6) comprising a small capacity (4 to 5 gallon) water storage vessel 29, a blending valve 4 mounted on a removable lid 29A of the vessel 29 so that the temperature control portion 12 of the valve 4 is located in the vessel 29, and an immersion heater of the type described in U.K. Pat. No. 1,331,618, the heater including a heating coil 33 for hot liquid and a temperature limiting valve 32 at the discharge 33A of the coil 33 supported by the lid 29A. An outlet 30 of the vessel 29 is connected to line 10A while return line 10B is coupled to an inlet 31 of the vessel 29. The temperature responsive element (not shown) in portion 12 of the valve 4 is immersed in the vessel 29 and the valve 4 discharges blended water towards the bottom of the vessel 29. Referring to FIGs. 5 and 6, the vessel 29 of unit 28 is specifically in the form of a closed-bottom cylinder, the top of which cylinder is closed by the removable lid 29A secured to the cylinder by bolts. As an example, the cylinder could have a depth of 18½ inches and a diameter of 11½ inches. A one-way valve 50 is carried by the valve 4 at the hot inlet 5 thereof and serves to preclude draw-back of hot liquid from the blending valve 4 to a high temperature circuit (later described), and a further one-way valve 51 carried by the cold inlet 7 of the valve 4 prevents liquid withdrawal from the valve 4 to the cold feed line 25. Feed lines 6 and 8 are connected to the valves 50, 51 respectively. Hot liquid is supplied to the coil 33 from feed line 6 via the one-way valve 50 and a conduit 52 connecting the valve 50 and inlet end 33A of the coil 33. A sight glass 53 (not shown in FIG. 4) is provided in the conduit 52. To facilitate installation at site, an alternative outlet 30A and an alternative inlet 31A are provided on the vessel 29 and are plugged during non-use. The unit 28 additionally includes a thermometer 54 indicating the temperature of the blended liquid in vessel 29 and a drain 55. An expansion outlet 56 is connected to calorifier expansion 57 by line 58. It is arranged that hot and cold feed water is supplied at approximately equal pressure to the valve 4.

Further, the calorifier 3 supplies one or more higher temperature outlets, for example hot taps 35, via pipeline 34 one-way valve 50 preventing withdrawal of liquid from the valve 4 to the line 34, and a return line 36 is provided from these outlets to the feedline 25, the coil 33 discharging into return line 36 via line 37. Alternatively, the line 36 could return separately to the calorifier 3. A pump 38 is provided in line 36, and the line 37 from coil 33 is connected to the suction side of pump 38 so that provided there is a head across the coil 33 hot water will be induced to flow through the coil 33 and the limiter valve 32 will control the rate of hot water flow so that the tepid water recirculated in lines 10A, 10B will be maintained at the correct temperature.

During a period of heavy draw-off, hot and cold water would be mixed in the blending valve 4 and passed through the vessel 29 to the draw-off points 2. During a period of no draw-off it is necessary to maintain an accurate temperature in the recirculation circuit, and thus high temperature water is passed to the heating coil 33 via line 52 and is pumped up through the coil 33 by pump 38 to discharge through the temperature limiting valve 32 and thence to the return line 36. The limiter valve 32 will operate in dependence on the recirculated water temperature at shower shut-off and will regulate the hot water flow rate in coil 33 in dependence on the temperature at the limiter valve 32 so as to maintain the recirculated water temperature constant. The temperature of the hot water in coil 33 must of course be greater than the recirculated water temperature; for example for a recirculated water temperature of 40°C a hot water temperature of 60°C in coil 33 is recommended.

During a period of no draw-off therefore, the temperature in the low temperature circuit 10A, 10B is maintained by the heating coil 33 and the temperature control is achieved by means of the temperature limiting valve 32. The blending valve 4 would not, in fact, be contributing to temperature control at all at this stage. The advantage of the arrangement however is that due to the blender element being immersed in the tepid or low temperature water the blender element will be maintained at the correct temperature thus the control valve in the blending valve 4 would be in the correct position so that as soon as draw-off takes place the valve 4 would not have to correct for temperature but should be in the position appropriate to that temperature.

In comparison with the previous embodiments, the calorifier unit 29 of FIGS. 5 and 6 facilitates the installation of the shower system at site since the unit 29 will be manufactured at the factory ready for installation and essentially all that will be required at site will be a fairly straightforward connecting up of the appropriate pipes: consequently the services of skilled personnel can be minimized.

The arrangement is intended:

1. to supply tepid or low temperature hot water to a large number of draw-off points;
2. to maintain the temperature in the low temperature or tepid water circuit during periods of no draw-off and when the tepid or low temperature water is being recirculated by a pump.
3. to accurately provide tepid or low temperature water at a single or small number of draw-off points. This feature is essential because it has been found from experience that if one blending valve is used to control the temperature on the supply to a large number of draw-off points then difficulties can be experienced when only one or a small number of draw-off points is used.

Figure 7:
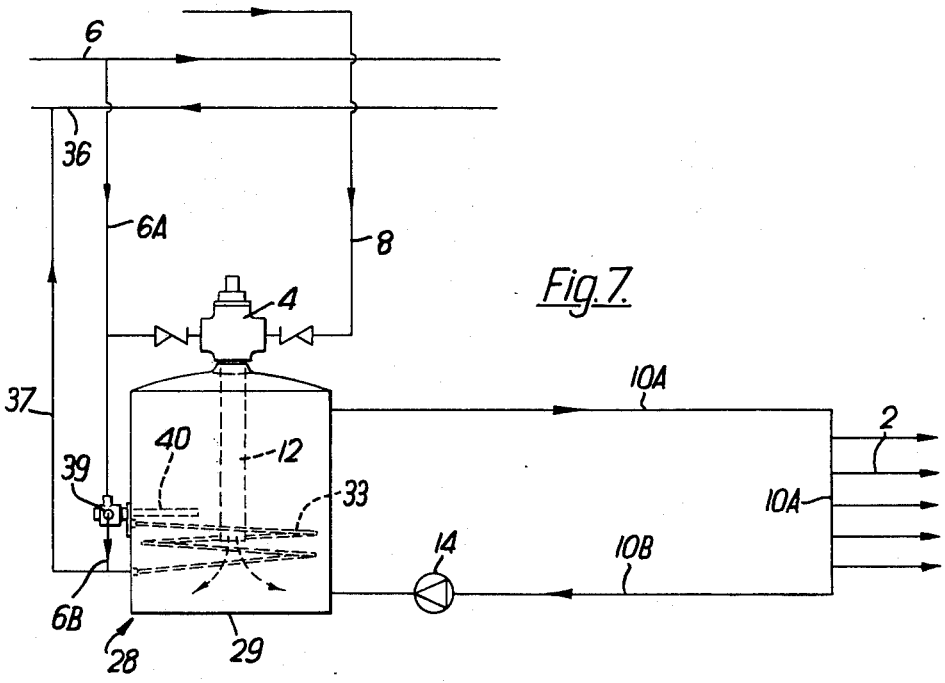
FIG. 7 shows a schematic view of a tepid water supply system generally similar to that of FIG. 4 but according to another embodiment of the present invention.

The embodiment of the present invention shown in FIG. 7 is generally similar to that of FIG. 4, but a diverting thermostatic valve 39 is used instead of the limiting valve, the valve 39 having diverting branch 6B. The valve 39 has a responsive element 40 located in the vessel 29, and controls the flow of heating water to the coil 33 in direct dependence on the temperature of the recirculated water in vessel 29: a suitable temperature control arrangement is shown in U.K. Pat. No. 1,170,580. Alternatively a thermostatic stop valve could be used.

The coil 33 is simply shown connected to high temperature water supply line 6 by line 6A: it will be understood that a hot water source other than the calorifier 3 can be used. 36 is the high temperature water return line.

Referring to FIG. 1, it may be desired that the calorifier 3 supplies hot water to facilitate other than the showers 2. These other facilities could for example be a central heating system and hot water taps, and the calorifier 3 would supply hot water at the highest temperature required by the facilities, the blending valve 4 serving to reduce the temperature appropriately for the domestic showers 2. The hot water supply to the other facilities could be via a supply line from feed line 6, but with this there is the risk that the hot water flow to the blending valve 4 may be reduced or indeed cease during recirculation flow through the circuit 10A, 10B, 16 of FIG. 1, so that the temperature of the blended water would fall to an unsatisfactory level. The circuit arrangement of FIG. 8 is intended to avoid this drawback.

Figure 8:
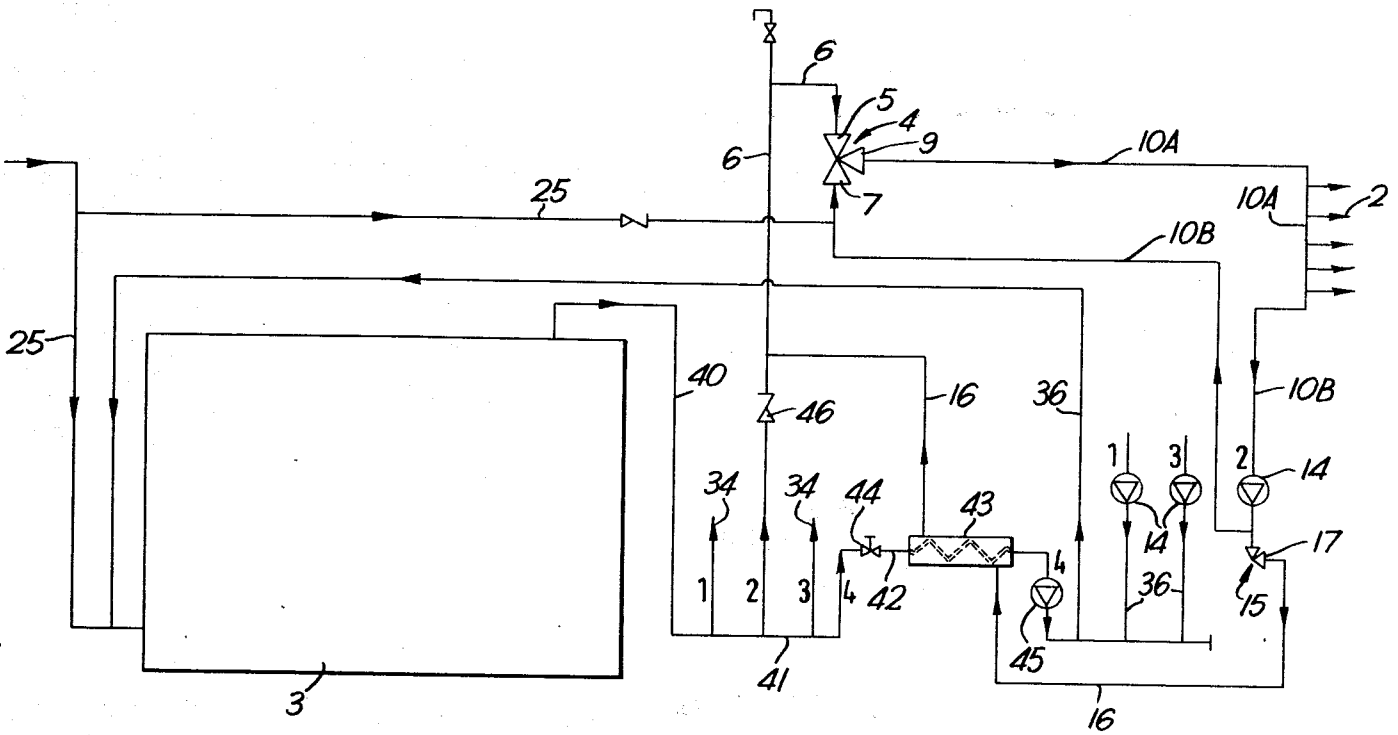
FIG. 8 shows a schematic view of a tepid water supply system according to yet a further embodiment of the present invention.

Referring to FIG. 8, a hot water boiler or calorifier 3 supplies high temperature water (~60°C) to several fluid circulate (only 10A, 10B shown). A manifold 41 drawing from the boiler 3 via line 40 supplies the various circuits with water via lines 6, 34; and these circuits may comprise high temperature circuits in the form of for example a central heating installation and a domestic hot water circuit, and a low temperature circuit (10A, 10B) for the supply of tepid water to a draw-off 2 such as baths, showers, etc., the various circuits including a pump 14 to effect water flow.

The low temperature circuit includes a blending valve 4 as before having a hot inlet 5 connected to the manifold 41 via line 6, a cold inlet 7 supplied from a source of cold water via line 25, and a blended fluid discharge 9 delivering to the draw-off 2 via line 10A and line 10B which returns to the cold inlet 7 as described for the embodiment of FIG. 1, the blending valve 4 thereby serving to provide water at the desired draw-off temperature (~40°C). As previously, the circuit (10A, 10B) includes a pump 14 for the recirculation of tepid water to the cold inlet 7 of the blending valve 4 and a thermostatic diverting valve 15 for diverting a portion of the recirculated water via a branch line 16. However, in the present embodiment, this branch line 16 is directly connected to the hot supply line 6 to the blending valve 4, and has a heat exchanger 43 intercalated therein for heating of the recirculated portion. Conveniently hot boiler water is used as heating medium for the heat exchanger and is supplied by a line 42 and having a flow control valve 44 from the manifold, a pump 45 being provided to facilitate heating medium flow through the heat exchanger 43. To avoid backflow from the branch line 16 to the manifold 41 a one-way valve 46 is appropriately located in the hot supply line 6 to the blending valve 4.

In operation of the low temperature circuit 10A, 10B, when there is no draw-off, tepid water recirculates via the circuit to the cold inlet 7 of the blending valve but the diverting valve 15 causes a small portion to be directed via the heat exchanger 43 to the blending valve hot inlet 5 to cater for heat losses in the circuit and thereby maintain the recirculated water at the desired temperature: all basically as before. However, in contrast, due to the use of the separate heat exchanger 43, the blending valve 4 will be supplied with hot recirculated water even when there is heavy hot draw-off to the high temperature circuits via lines 34 from the mainfold 41, the one-way valve 46 in the supply line 6 to the primary circuit preventing fluid draw-back from the low to the high temperature circuits. When the draw-off (showers, etc.,) from the low temperature circuit (10A, 10B) is heavy so that there is little or no fluid recirculation in the primary circuit, the blending valve 4 is supplied with hot and cold water from the manifold 41 and cold source (not shown) respectively.

Modifications are possible in the above described arrangements. For example, in the system of FIG. 4, the blending valve 4 could be located separate from the vessel 29, and the blended water passing from discharge 9 would be fed to the vessel 29 by suitable conduit means.

I claim:

1. A recirculation fluid supply system for the supply of temperature blended fluid to a draw-off comprising:

a. a thermostatic blending valve having:
   i. hot and cold inlets for receiving relatively hot and cold fluids respectively from supply sources;
   ii. a mixing portion wherein mixing of the hot and cold fluids occurs;
   iii. a temperature control portion receiving blended fluid from the mixing portion and including a thermostat;
   iv. valve means operable by the thermostat to regulate the openings of the hot and cold inlets; and
   v. a blended fluid discharge from the temperature control portion;

b. a supply conduit connected to the blended fluid discharge of the blending valve for the supply of temperature blended fluid to the draw-off;

c. return conduit means for recirculating the bulk of the temperature blended fluid from the draw-off to the thermostat of the blending valve when the draw-off is closed so that the thermostat of the blending valve is responsive to the temperature of the recirculated blended fluid;

d. means for pumping the blended fluid in the supply conduit and in the return conduit means; and e. temperature control means to maintain the temperature of the recirculated blended fluid at the desired draw-off temperature whereby the thermostat responsive to the recirculated fluid temperature operates to set the valve means of the blending valve for delivery of blended fluid by the valve at the desired draw-off temperature when the draw-off is re-opened.

2. The fluid supply system as claimed in claim 1, wherein the return conduit means includes a primary conduit from the draw-off to the blending valve, the primary conduit having a pump therein, and the temperature control means include a thermostatic diverting valve in the primary conduit having a branch discharge for the diversion of recirculated fluid to the hot fluid supply source, and cold feed conduit means are connectible to a cold fluid supply source for the supply of cold feed to the hot fluid supply source and to the blending valve, the arrangement being such that when the temperature of the recirculated fluid falls below a selected value the thermostatic diverting valve directs a portion of the recirculated fluid to the hot supply source to provide an increased flow of hot fluid to the hot inlet of the blending valve to increase the temperature of the blended fluid to the selected temperature but when the recirculated fluid reaches said selected temperature substantially all the recirculated fluid is directed to the blending valve via the primary conduit.

3. The fluid supply system as claimed in claim 2, wherein the thermostatic diverting valve comprises a housing having a fluid inlet duct and a fluid outlet duct with the primary conduit connected to said ducts so that the recirculated fluid flowing to the cold inlet passes through the housing, a valve body secured to said housing and including a thermo-responsive element projecting into the housing to be in the flow stream of the recirculated fluid, a branch discharge on the valve body fluidly connected to the hot fluid supply source, and a valve opening in the valve body controllable by a closure head operatively coupled to the thermo-responsive element for control of recirculated fluid outflow via the branch discharge.

4. The fluid supply system as claimed in claim 2, wherein the primary conduit is connected to the cold inlet of the blending valve.

5. The fluid supply system as claimed in claim 2, wherein the primary conduit is connected to an external fluid inlet duct discharging into the temperature control portion of the blending valve, so that the fluid recirculated by the primary conduit by-passes the mixing portion of the blending valve.

6. The fluid supply system as claimed in claim 1, wherein a calorifier unit is provided and includes a vessel for receiving recirculated fluid from the draw-off and having a discharge for outflow of fluid to the draw-off, and said thermostatic blending valve is carried by the vessel and discharges into the vessel, the thermostat of the blending valve controlling the blended fluid temperature and being located in the vessel to be responsive to the temperature of recirculated fluid therein, and said temperature control means includes means for delivering heating medium to the vessel and a control device carried by the vessel controlling the flow of heating medium to the vessel so as to maintain the recirculated fluid flowing through the vessel at the desired temperature.

7. The fluid supply system as claimed in claim 6, wherein the temperature control means comprise a heat exchanger conduit for heating fluid extending into the vessel and temperature control valve means sensing the temperature of fluid in the vessel and regulating the flow of heating fluid through the heat exchange conduit in dependence on the sensed temperature.

8. The fluid supply system as claimed in claim 7, wherein the temperature control valve means are constituted by a temperature limiting valve located at a discharge from the heat exchange conduit and sensing the discharge temperature of the heating fluid.

9. The fluid supply system as claimed in claim 7, wherein the temperature control valve means are constituted by a thermostatic valve having a temperature responsive element projecting into the vessel.

10. The fluid supply system as claimed in claim 1, wherein the return conduit means includes a primary circuit linking the draw-off with a cold inlet of the blending valve said temperature control means including a temperature responsive diverting valve in the primary conduit and a branch portion of which valve is fluidly connected to a branch circuit discharging into the hot inlet of the blending valve, heat exchanger means being located in this branch portion for heating the portion of recirculated fluid flowing in the branch portion to the hot inlet so as to maintain the desired draw-off temperature of the recirculated fluid.

11. A calorifier unit for use in a fluid recirculation supply system supplying a draw-off, the unit comprising a vessel having a fluid outlet adapted for connection to a conduit delivering fluid to the draw-off and a fluid inlet adapted for connection to a return conduit from the draw-off; a thermostatic blending valve mounted on the vessel and having inlets for hot and cold liquids to be blended, a discharge for blended liquid discharging into the vessel, and a temperature responsive element controlling the blended liquid temperature located in the vessel to be responsive to the temperature of the fluid therein; fluid heating means projecting into the vessel, and a temperature controller for the fluid heating means carried by the vessel and controlling the operation of the heating means to maintain the temperature of liquid in the vessel at a predetermined value.

12. A calorifier unit as claimed in claim 11, including one-way valves for the blending valve inlets.

13. A calorifier unit as claimed in claim 11, wherein the blending valve, the fluid heating means and the temperature control means are carried by a removable lid of the vessel.

* * * * *